US011230888B2

(12) United States Patent
Peter

(10) Patent No.: US 11,230,888 B2
(45) Date of Patent: Jan. 25, 2022

(54) SEAL ASSEMBLY FOR DOWNHOLE USE

(71) Applicant: Baker Hughes, Houston, TX (US)

(72) Inventor: Andreas Peter, Niedersachsen (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 22 days.

(21) Appl. No.: 16/216,323

(22) Filed: Dec. 11, 2018

(65) Prior Publication Data

US 2020/0181983 A1 Jun. 11, 2020

(51) Int. Cl.
*E21B 10/25* (2006.01)

(52) U.S. Cl.
CPC ..... *E21B 10/25* (2013.01)

(58) Field of Classification Search
CPC ..... F16J 15/32; E21B 10/25; E21B 10/225
See application file for complete search history.

(56) References Cited

U.S. PATENT DOCUMENTS 4,915,892 A 4/1990 Peppiatt
8,967,301 B2 3/2015 Curry et al.
2003/0090067 A1 5/2003 Morvant
2005/0062235 A1* 3/2005 Keene ..... E21B 33/03 277/603
2006/0032673 A1 2/2006 Yong et al.
2010/0148447 A1* 6/2010 Hailing ..... E21B 33/04 277/314
2013/0180733 A1 7/2013 Bradshaw et al.
2016/0319087 A1* 11/2016 Niihara ..... C08J 5/005
2020/0018397 A1* 1/2020 Arteaga ..... F16J 15/48

OTHER PUBLICATIONS

PCT/US2019/065517 International Search Report and the Written Opinion of the International Searching Authority, or the Declaration, dated Apr. 9, 2020, 11 pages.

* cited by examiner

*Primary Examiner* — Dany E Akakpo
(74) *Attorney, Agent, or Firm* — Bracewell LLP; Keith Derrington

(57) ABSTRACT

A seal assembly for downhole use that includes a sealing ring, and a backup ring set generally coaxial with and adjacent to the sealing ring. A height of the backup ring exceeds a diameter of the sealing ring; and is disposed on a low pressure side of the seal assembly to prevent the sealing ring from extruding into the low pressure side. The backup ring is made of a core and a coating on the core. Material properties of the coating are generally unaffected when exposed to downhole conditions, and the coating prevents diffusion of fluid or gas molecules into the low pressure side.

19 Claims, 5 Drawing Sheets

SEAL ASSEMBLY FOR DOWNHOLE USE

BACKGROUND OF THE INVENTION

1. Field of Invention

The present disclosure relates to a downhole seal assembly that includes a backup ring having a body coated with a material having a greater resistance to fluid diffusion than that of the backup ring body.

2. Description of Prior Art

Hydrocarbons are usually produced from within a subterranean formation through a wellbore that intersects the formation. Wellbores are generally formed with drilling assemblies made up of a drill string that is rotated on surface by a top drive or rotary table. Drill strings typically include lengths of tubulars joined together in series, and a drill bit attached to a lower end of the series of tubulars. Pressure control of the wellbore is usually provided by a wellhead assembly mounted to the entrance of the wellbore. A wide range of operations are conducted in most wells after being drilled; such as wellbore completion where the well is lined with casing and perforated to provide communication between the formation and wellbore annulus. Additional wellbore operations often undertaken are imaging or logging, intervention, and work overs.

Types of downhole tools deployed for such wellbore operations include perforating guns, logging tools, jars, rollers, tractors, milling tools, cutting tools, expanding tools, setting tools, retrieving tools, bailers, baskets, fishing tools, seismic tools, vacuum cleaners, tubular patching devices, to name a few. Most downhole tools are sealed to prevent downhole fluid from seeping inside the tool, and where it could damage circuitry and other components susceptible to fluid damage. Current sealing systems include elastomeric seals, that may lack sufficient strength to withstand pressure differentials present when downhole. Further, elastomeric seals have fluid diffusion limits; which are reduced when exposed to the high temperature conditions that are often present downhole.

SUMMARY OF THE INVENTION

An example of a downhole device for use in a wellbore is disclosed, and which includes an outer section, an inner section partially inserted within the outer section, an interface defined between the inner and outer sections having a high pressure zone and a low pressure zone, and a seal assembly in the interface. The seal assembly of this example is made up of an O-ring having a lateral side exposed to the high pressure zone, and a backup ring disposed on a side of the O-ring opposite from the high pressure zone; the backup ring having an elastomeric or polymeric core coated with a layer of metal. Fibers are optionally provided that are strategically oriented in the core, so that thermal expansion of the core is restricted. In an embodiment, the fibers are elongate members, and where arrays are defined in the core by groups of adjacently disposed fibers that are oriented in parallel. In an embodiment, the fibers are disposed oblique to one another. An example of the outer section includes a housing, and the inner section has an end cap, and wherein the device is a downhole tool having components disposed within the housing and on a side of the seal assembly opposite the high pressure zone. The seal assembly in this example is disposed in a groove formed in the end cap. The backup ring and O-ring are optionally substantially coaxial, and the backup ring optionally has a depression along a side adjacent the O-ring and in which the O-ring is in selective contact. Alternatively, a side of the backup ring opposite the depression is set against a gap formed between the inner and outer sections, and forms a barrier between the O-ring and the gap.

Another example of a downhole device for use in a wellbore is described and that includes a housing having an outer surface, a chamber inside the housing, a flow path extending between the outer surface and chamber, and a seal assembly disposed in the flow path and that includes an O-ring having a side in communication with the outer surface, and a backup ring adjacent the O-ring and having a side in communication with the chamber, the backup ring that includes a coating with physical properties that remain substantially consistent when exposed to downhole fluid. Embodiments of the backup ring include an elastomeric or polymeric core, and where the coating contains metal. Types of device include tools such as an imaging tool, a perforating gun, an electrical submersible pump, a logging tool, a measurement-while drilling tool, a rotary steerable tool, a drill bit, and combinations thereof. The elongate fibers are optionally disposed in the core. In one example the fibers are glass. Alternatively, the fibers and the coating are formed from the same material.

Yet another example of a downhole device for use in a wellbore is described, and includes a first section having an outer surface, a second section coupled with the first section, an interface formed between portions of the first and second sections, and a seal assembly disposed along the interface that includes a backup ring with a coating that remains substantially the same when exposed to a temperature increase. The downhole device optionally includes a chamber, and wherein a high pressure zone is defined between the seal assembly and outer surface, and a low pressure zone is defined between the seal assembly and the chamber. In an alternative, the backup ring further includes a core that is covered by the coating, and a means for restricting expansion of the core to avoid cracking the coating when the backup ring is exposed to high temperatures. An O-ring is optionally included with the seal assembly, and which is set adjacent the backup ring and having a side in pressure communication with the outer surface. In an embodiment, a side of the backup ring opposite the O-ring faces a gap formed between the first and second sections, and forms a barrier between the gap and O-ring. Elongate glass fibers are optionally provided in the backup ring.

BRIEF DESCRIPTION OF DRAWINGS

Some of the features and benefits of the present invention having been stated, others will become apparent as the description proceeds when taken in conjunction with the accompanying drawings, in which.

Figure 1:
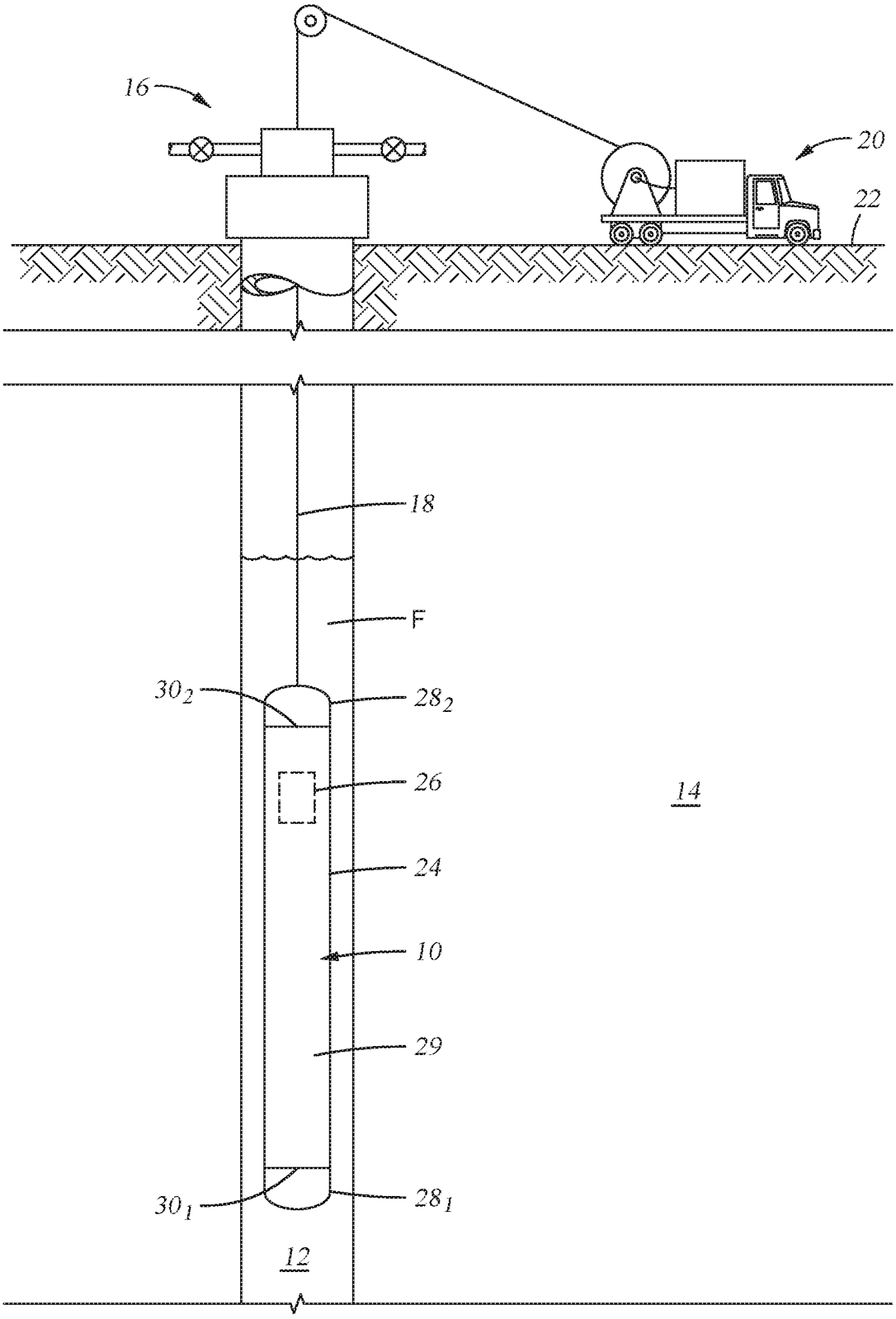
FIG. 1 is a side partial sectional view of an example of a downhole tool disposed in a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Illustrated in FIG. 1 is a partial side sectional view of an example of a downhole tool 10; where the tool 10 is deployed within a wellbore 12 which intersects a formation 14. A wellhead assembly 16 is shown secured to an upper end of wellbore 12; which provides fluid and pressure control for the wellbore 12. A wireline 18, which is used for deployment and control of tool 10 is threaded through the wellhead assembly 16. An end of wireline 18 opposite from tool 10 couples to a service truck 20 shown on surface 22. A reel (not shown) is optionally provided within service truck 20 and on which wireline 18 is wound; thus rotating reel selectively raises and lowers tool 10, depending on the direction of rotation. An optional controller (not shown) is provided within truck 20 for receiving and/or providing communication to tool 10 via wireline 18. Wireline 18 provides one way of deploying and controlling tool 10; where other deployment means include slick line, jointed tubing, and coiled tubing.

Further depicted in the example of FIG. 1 is a housing 24 that provides an outer covering for tool 10, and for protecting tool components 26 (shown in dashed outline) within tool 10. Example tool components 26 include imaging devices, pumps, motors, sensors, transmitters, to name a few. Embodiments exist where the tool components 26 include any type of device housed within a tool; and that is susceptible to damage when exposed to conditions within a wellbore, or might also be damaged by contact with fluid in a wellbore. In the example of FIG. 1, tool 10 includes a pair of endcaps $\mathbf{28}_{1,2}$ and which mounts to axial ends of housing 24 thereby encasing tool component 26 within. Endcaps $\mathbf{28}_{1,2}$ and housing 24 define a chamber 29 within tool 10; and chamber 29 forms a space in which component 26 is disposed. Interfaces $\mathbf{30}_{1,2}$ are formed where the housing 24 joins with endcaps $\mathbf{28}_{1,2}$. As described in detail below, the sealing along interfaces $\mathbf{30}_{1,2}$ forms a barrier to block fluid F within wellbore 12 from migrating into the chamber 29; thereby protecting the tool component 26 from exposure and possible damage from being in contact with fluid F. In an example, the sealing along interfaces $\mathbf{30}_{1,2}$ also forms an environmental barrier that blocks pressure communication between the inside of wellbore 12 and chamber 29.

Figure 2:
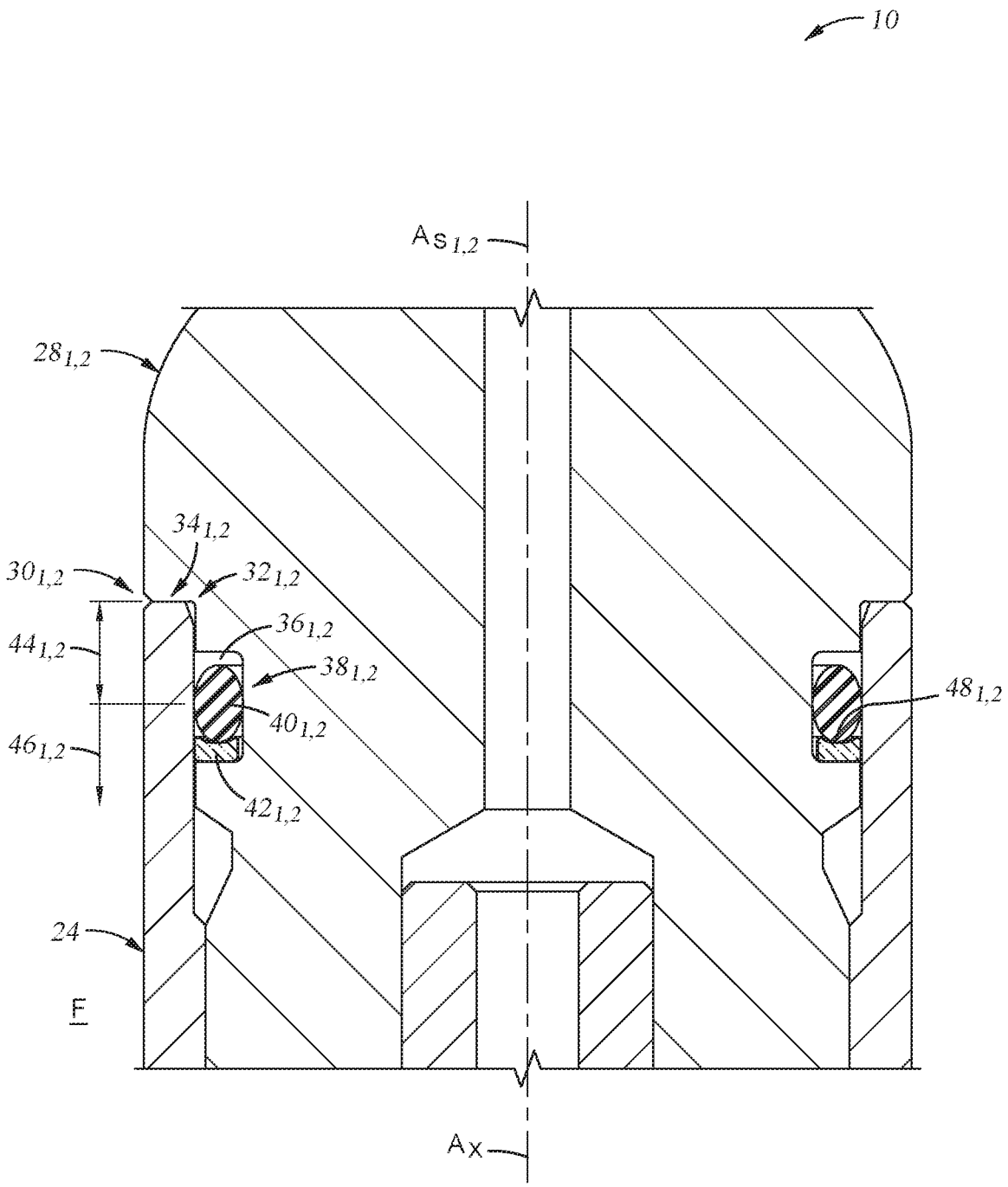
FIG. 2 is a side sectional view of a portion of the tool of FIG. 1 equipped with an example of a seal assembly.

Referring now to FIG. 2 a side sectional view of a portion of tool 10 is schematically illustrated depicting a portion of endcaps $\mathbf{28}_{1,2}$ inserted into an open end of housing 24. Outer circumferences of endcaps $\mathbf{28}_{1,2}$ project radially outward at transitions $\mathbf{32}_{1,2}$ and which form annular spaces $\mathbf{34}_{1,2}$ that circumscribe portions of endcaps $\mathbf{28}_{1,2}$. As illustrated, ends of housing 24 receive the respective portions of endcaps $\mathbf{28}_{1,2}$ within, and the sidewalls of housing 24 are disposed within annular spaces $\mathbf{34}_{1,2}$. Interaction between the ends of housing 24 and endcaps $\mathbf{28}_{1,2}$ along the annular spaces $\mathbf{34}_{1,2}$ defines portions of interfaces $\mathbf{30}_{1,2}$. Also formed along an outer surface of endcaps $\mathbf{28}_{1,2}$, and in the region of the annular spaces $\mathbf{34}_{1,2}$, are grooves $\mathbf{36}_{1,2}$ formed into endcaps $\mathbf{28}_{1,2}$. An embodiment of seal assemblies $\mathbf{38}_{1,2}$ is shown disposed within grooves $\mathbf{36}_{1,2}$; and which provides a barrier to communication along interface $\mathbf{30}_{1,2}$. In the example illustrated, seal assemblies $\mathbf{38}_{1,2}$ include O-rings $\mathbf{40}_{1,2}$ that are disposed in grooves $\mathbf{36}_{1,2}$; and which in an embodiment define sealing rings. In the example shown, seal assemblies $\mathbf{38}_{1,2}$ further include backup rings $\mathbf{42}_{1,2}$ shown positioned on a side of O-rings $\mathbf{40}_{1,2}$ distal from transitions $\mathbf{32}_{1,2}$. As noted above, the presence of seal assemblies $\mathbf{38}_{1,2}$ provides a barrier between the outer surface of tool 10 and its inner chamber 29 (FIG. 1). Examples exist where barriers defined by the seal assemblies $\mathbf{38}_{1,2}$ are to one or more of pressure and fluid. For the purposes of illustration herein, high pressure zones $\mathbf{44}_{1,2}$ are illustrated between O-rings $\mathbf{40}_{1,2}$ and along interfaces $\mathbf{30}_{1,2}$ up to about transitions $\mathbf{32}_{1,2}$. Similarly, low pressure zones $\mathbf{46}_{1,2}$ are illustrated extending from sides of O-rings $\mathbf{40}_{1,2}$ opposite high pressure zones $\mathbf{44}_{1,2}$ and depending within housing 24. Optionally, seal assemblies $\mathbf{38}_{1,2}$ have axes $As_{1,2}$ parallel or coincident with an axis Ax of tool 10. In an example, seal assembly $\mathbf{38}_{1,2}$ includes sealing elements in place of, or in addition to. O-rings $\mathbf{40}_{1,2}$; the configurations of which have cross-sections such as round, square, X-shaped, T-shaped, and combinations thereof. In an optional embodiment, the sealing elements urges backup-rings $\mathbf{42}_{1,2}$ radially outward and into contact with the inner surface of housing 24.

Figure 3:
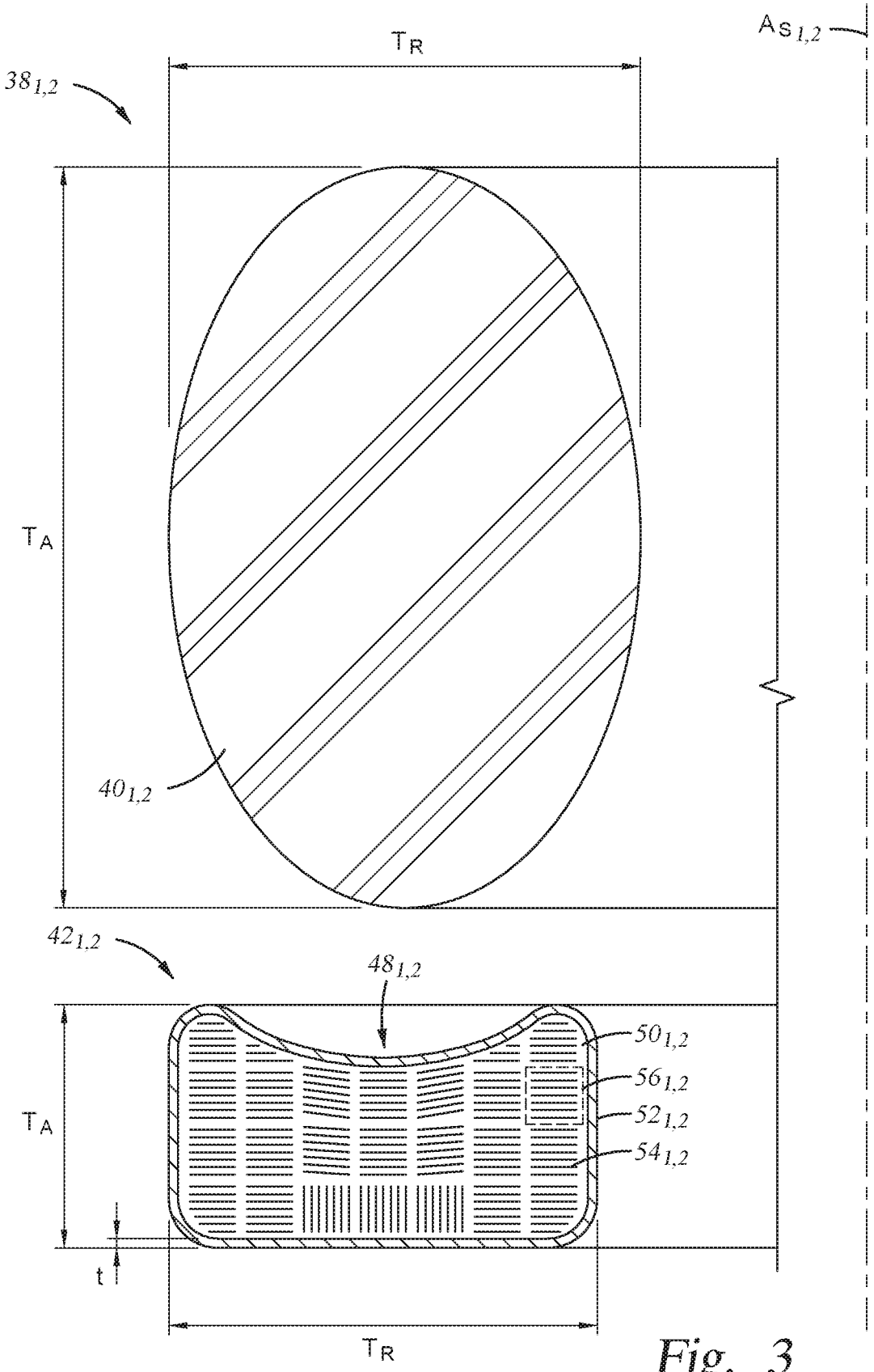
FIG. 3 is a side sectional view of an example of an O-ring and backup ring of the seal assembly of FIG. 2.
Figure 4:
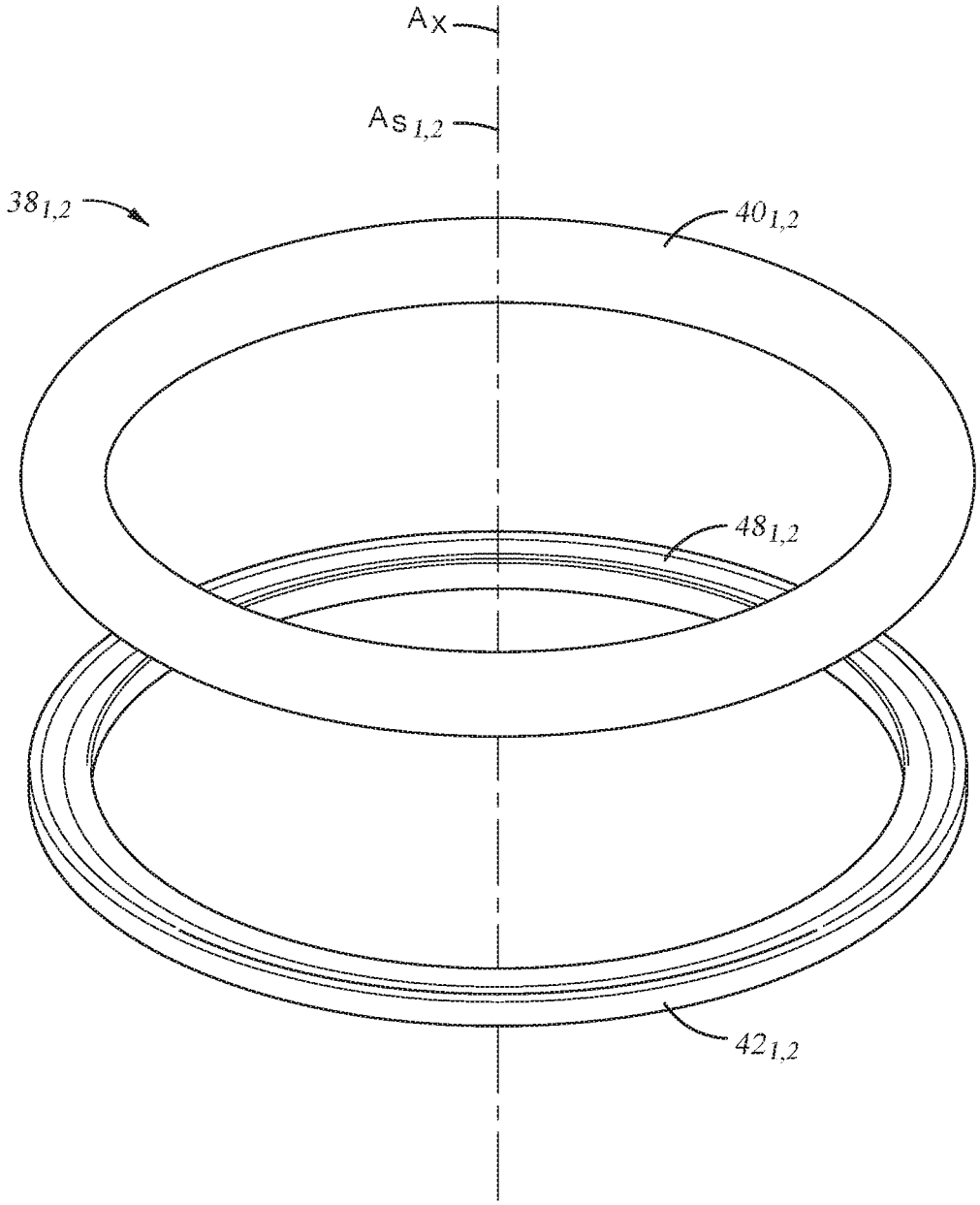
FIG. 4 is a perspective view of an example of an O-ring and backup ring of the seal assembly of FIG. 2.

Referring now to FIGS. 3 and 4, shown are examples of the O-rings $\mathbf{40}_{1,2}$ and backup rings $\mathbf{42}_{1,2}$ of seal assemblies $\mathbf{38}_{1,2}$; radial sectional views are provided in FIG. 3, and perspective views are in FIG. 4. As shown in the radial sectional view of FIG. 3; bodies of the O-rings $\mathbf{40}_{1,2}$ have a generally curved outer surface, and with axial and radial thicknesses of $T_A$ and $T_R$ respectively. The backup rings $\mathbf{42}_{1,2}$ of FIG. 3 are generally annular, and with bodies having cross sections resembling a rectangle; but with depressions $\mathbf{48}_{1,2}$ formed along radial surface that faces O-rings $\mathbf{40}_{1,2}$. Example materials for O-rings $\mathbf{40}_{1,2}$ include polymers, elastomers, combinations, and the like. Backup rings $\mathbf{40}_{1,2}$ are shown made up of cores $\mathbf{50}_{1,2}$, each of which are covered in a layer of coating $\mathbf{50}_{1,2}$. Example materials for core $\mathbf{50}_{1,2}$ include polymers, elastomers, combinations, and the like. Example materials for coatings $\mathbf{52}_{1,2}$ include metal and inorganic materials, and any other materials that substantially maintain their physical properties when subjected to downhole temperatures. One example of maintaining physical properties is that the rate of fluid that diffuses through the material remains substantially the same when the material experiences a change in temperature. In an alternative, coatings $\mathbf{52}_{1,2}$ include a material that has an operational temperature limit greater than that of the O-rings $40_{1,2}$ or the cores $50_{1,2}$. One example of substantially maintaining physical properties is that the strength of the material, such as its yield strength or Young's modulus, when subjected to a high temperature will remain within a range so that the material does not deform under normal operating conditions. Backup rings $42_{1,2}$ with coatings $52_{1,2}$ made from material that retains its strength when subjected to high temperature will maintain a barrier or backstop for supporting the O-rings $40_{1,2}$ when exposed to the high temperatures expected downhole. Moreover, as noted above, in an example where coatings $52_{1,2}$ are made from material that maintains its physical properties when exposed to downhole temperatures, the material also maintains its diffusivity characteristics when downhole. Thus the coatings $52_{1,2}$ when downhole will form a barrier to fluids in the wellbore to protect components in the chamber 29 from exposure to wellbore fluids. Examples of such damage are corrosion of metallic components or chemical decomposition of polymeric components within chamber 29 when molecules of wellbore fluid (including connate fluid) migrate thru the O-rings $40_{1,2}$ and uncoated backup rings $42_{1,2}$, the motion driven by a differential concentration of the higher pressure wellbore fluid and the lower pressure within the chamber 29. Another example of such damage is chemical degradation of components in chamber 29 when $H_2S$ gas migrates thru a traditional seal assembly (not shown) having an O-ring and uncoated backup ring. Because the O-rings $40_{1,2}$ are pressing the backup rings $42_{1,2}$ into intimate contact with the low pressure side wall of the sealing groove, and the inner diameter of the housing 24, driven by the high pressure; the coating forms a diffusion tight barrier with the surface of the groove wall. Examples exist where expected downhole temperatures exceed 150° F., exceed 285° F., and exceed 300° F. Accordingly, materials that maintain structural integrity such that the function of the backup rings $42_{1,2}$ remains viable in high temperatures expected downhole are material candidates for the coating $52_{1,2}$. Any now known or future developed method of applying the coating $52_{1,2}$ over the cores $50_{1,2}$ is included in this disclosure. Known examples include vapor deposition, electromechanical plating, electrochemical plating, combinations thereof and the like.

Still referring to FIG. 3, an axial thickness TA of backup rings $42_{1,2}$ is shown being less than its radial thickness $T_R$. Also as shown, the thickness t of coating $52_{1,2}$ is illustrated as being substantially less than dimensions of the core $50_{1,2}$. Further provided in example of FIG. 3 are fibers $54_{1,2}$ disposed throughout the core $50_{1,2}$. In an example, fibers $54_{1,2}$ that are adjacent and bind with one another form arrays $56_{1,2}$ that are set in different locations within core $50_{1,2}$. Strategically arranging the fibers $54_{1,2}$ and/or arrays $56_{1,2}$ provides the ability of core $50_{1,2}$ to be restricted in its thermal expansion and thus avoid the possibility of producing cracks within the coatings $52_{1,2}$. Example materials for fibers $54_{1,2}$ include fiberglass, nanoparticle, carbon, and metal, to name a few. In an alternative, the material of the fibers $54_{1,2}$ is the same as that of the coating $52_{1,2}$. Further, examples exist where a length of the fibers $54_{1,2}$ is substantially that of the radial thickness $T_R$ of core $50_{1,2}$ or the axial thickness TA of core $50_{1,2}$. Further examples exist where the fibers $54_{1,2}$ are arranged at oblique orientations to one another to provide a resistive effect to the thermal expansion of the material making up the core $50_{1,2}$. As illustrated in FIG. 4, in one example the O-rings $40_{1,2}$ and backup rings $42_{1,2}$ are arranged in a fashion that they are generally concentric about axis Ax.

Figure 5:
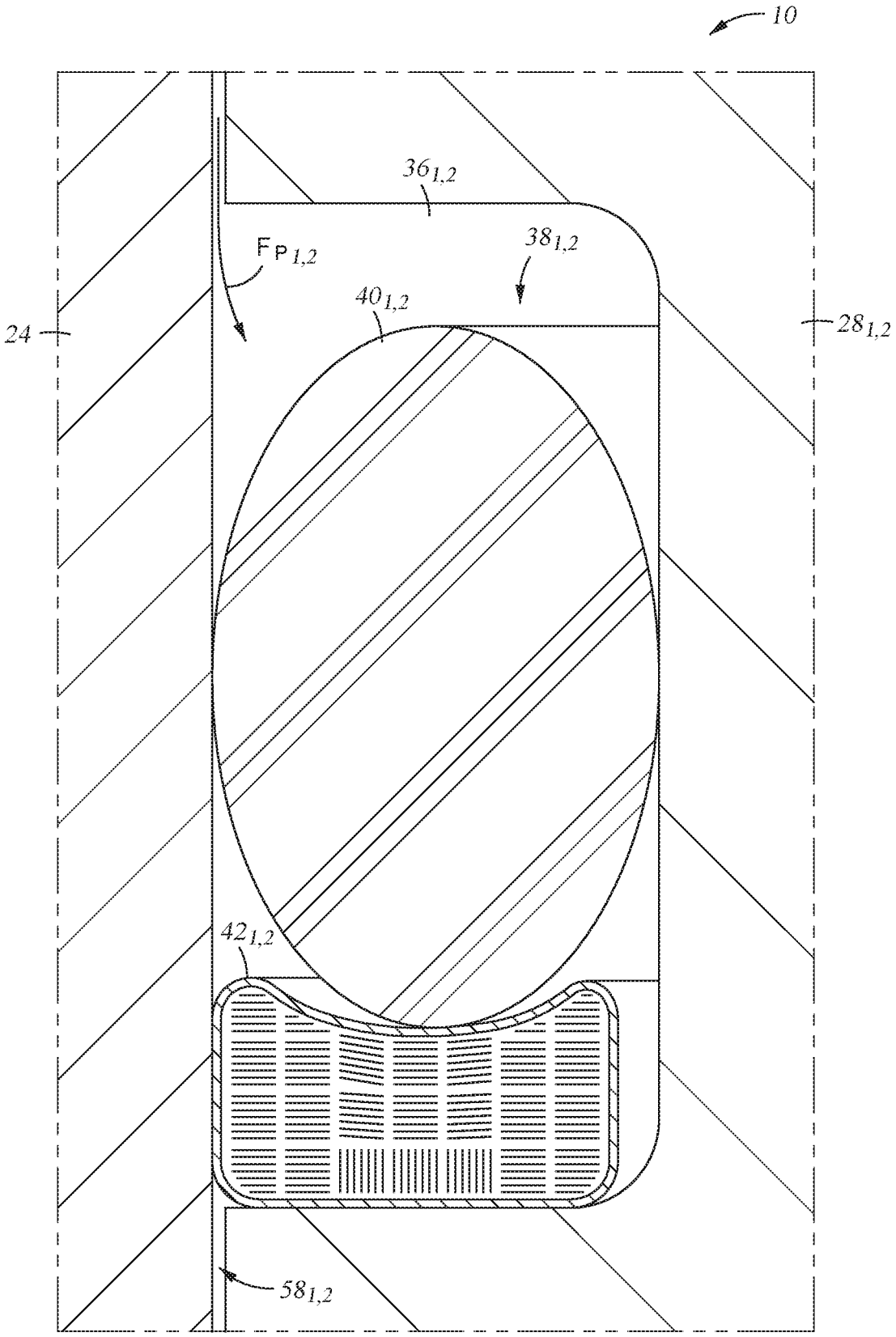
FIG. 5 is an enlarged side sectional view of the seal assembly of FIG. 2.

Referring now to FIG. 5 shown in a side sectional view is an example of seal assemblies $38_{1,2}$ set in grooves $36_{1,2}$. Depicted in FIG. 5 is an example of flow paths $F_{P1,2}$ intersecting grooves $36_{1,2}$ and extending to gaps $58_{1,2}$ disposed on low pressure zones $46_{1,2}$ (FIG. 2) of seal assemblies $38_{1,2}$. Flow paths $F_{P1,2}$ illustrate an example of communication along interfaces $30_{1,2}$ possible without the presence of the seal assemblies $38_{1,2}$. However, the seal assemblies $38_{1,2}$ define barriers to flow paths $F_{P1,2}$, and as described above define the high and low pressure zones $44_{1,2}$ and $46_{1,2}$ (FIG. 2). As discussed below the radial thickness $T_R$ (FIG. 3) of backup rings $42_{1,2}$ exceeds that of O-rings $40_{1,2}$ so that presence of backup rings $42_{1,2}$ prevents extrusion of O-rings $40_{1,2}$ and into gaps $58_{1,2}$. In this example, gaps $58_{1,2}$ are formed along interfaces $30_{1,2}$ and between housing 24 and endcaps $28_{1,2}$.

Referring back to FIG. 2 outer surfaces of housing 24 and endcaps $28_{1,2}$ define an outer surface of downhole tool 10. Further in this example is that high pressure from the outer surfaces communicates partially along interfaces $30_{1,2}$ and up to the seal assemblies $38_{1,2}$; where the high pressure is applied to lateral surfaces of O-rings $40_{1,2}$. Depressions $48_{1,2}$ provide seating surfaces for contact with O-rings $40_{1,2}$, when pressure from wellbore 12 is exerted along interfaces $30_{1,2}$. In a non-limiting example of operation, pressure differentials are generated across seal assemblies $28_{1,2}$ in response to the pressure applied in interfaces $30_{1,2}$ from the outer surface. The pressure differentials in turn urge O-rings $40_{1,2}$ into depressions $48_{1,2}$. Examples exist where the cross section of the backup rings $42_{1,2}$ differs from that in FIG. 3, but which still provide a supporting surface for receiving O-rings $40_{1,2}$. Alternate applications of the seal assemblies $38_{1,2}$ include that within an imaging tool, perforating gun, an electrical submersible pump, a logging tool, a measurement-while drilling tool, a rotary steerable tool, a drill bit, in combinations thereof. Examples exist where the thickness t of coating $52_{1,2}$ varies depending on the material of the coating $52_{1,2}$, material of the core $50_{1,2}$, as well as the expected operating conditions within a wellbore 12 (FIG. 1). Another example application for the seal assemblies $38_{1,2}$ is found in Curry et al., U.S. Pat. No. 8,967,301; which is incorporated by reference herein in its entirety for all purposes.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A downhole device for use in a wellbore comprising:

an outer section;

an inner section partially inserted within the outer section;

an interface defined between the inner and outer sections having a high pressure zone and a low pressure zone; and a seal assembly in the interface that comprises, a sealing ring having a side exposed to the high pressure zone, a backup ring disposed on a side of the sealing ring opposite from the high pressure zone and that comprises a core that is coated, and a first set of fibers in the core oriented substantially axially in the seal assembly and a second set of fibers in the core that are oriented substantially oblique to the first set of fibers, the first and second sets of fibers in a strategic arrangement that restricts thermal expansion of the core, wherein fibers in one of the first set of fibers and in the second set of fibers that are adjacent and bind with one another to form arrays that are set in different locations within the core.

2. The device of claim 1, wherein arrays are defined in the core by groups of adjacently disposed fibers in one of the first set of fibers or second set of fibers and that are oriented in parallel.

3. The device of claim 1, wherein the outer section comprises a housing and the inner section comprises an end cap, and wherein the device comprises a downhole tool having components disposed within the housing and on a side of the seal assembly opposite from the high pressure zone.

4. The device of claim 3, wherein the seal assembly is disposed in a groove formed in the end cap.

5. The device of claim 1, wherein the backup ring and sealing ring are substantially coaxial, and the backup ring comprises a depression that is in selective contact with the sealing ring.

6. The device of claim 5, wherein a side of the backup ring opposite the depression is set against a gap formed between the inner and outer sections, and forms a barrier between the sealing ring and the gap.

7. The device of claim 1, wherein the core comprises a polymer and the coating comprises metal.

8. The device of claim 1, wherein the lengths of the fibers are substantially that of a radial thickness of the core or an axial thickness of the core.

9. The device of claim 1, wherein fibers in the second set of fibers are oriented substantially perpendicular to fibers in the first set of fibers.

10. A downhole device for use in a wellbore comprising:

a housing having an outer surface;

a chamber inside the housing;

a flow path extending between the outer surface and chamber; and a seal assembly disposed in the flow path and that comprises, a sealing ring having a side in communication with the outer surface, and a backup ring adjacent the sealing ring having a side in communication with the chamber, a core, a coating over the core, and fibers that are adjacent and bind with one another to form arrays that are strategically oriented oblique to one another for restricting thermal expansion of the core to prevent cracking of the coating.

11. The device of claim 10, wherein the core comprises polymer, and where the coating comprises metal.

12. The device of claim 10, wherein the device comprises a tool selected from the group consisting of an imaging tool, a perforating gun, an electrical submersible pump, a logging tool, a measurement-while drilling tool, a rotary steerable tool, a drill bit, and combinations thereof.

13. The device of claim 10, wherein the fibers comprise glass, carbon fiber, and combinations thereof.

14. The device of claim 10, wherein the fibers and the coating comprise the same material.

15. A downhole device for use in a wellbore comprising:

a first section having an outer surface;

a second section coupled with the first section;

an interface formed between portions of the first and second sections; and a seal assembly disposed along the interface that comprises a backup ring that comprises a coating over a core, and a first array of fibers in the core arranged substantially perpendicular to a second array of fibers in the core, the first and second array of fibers are defined by fibers that are adjacent and bind to one another.

16. The downhole device of claim 15, further comprising a chamber, and wherein a high pressure zone is defined between the seal assembly and outer surface, and a low pressure zone is defined between the seal assembly and the chamber.

17. The downhole device of claim 15, wherein the seal assembly further comprises a sealing ring set adjacent the backup ring and having a side in pressure communication with the outer surface.

18. The downhole device of claim 17, wherein a side of the backup ring opposite the sealing ring faces a gap formed between the first and second sections, and forms a barrier between the gap and sealing ring.

19. The downhole device of claim 15, wherein the fibers are elongate and comprise glass.

* * * * *